US005766413A

United States Patent [19]

Backlund et al.

[11] Patent Number: 5,766,413

[45] Date of Patent: Jun. 16, 1998

[54] PROCESS FOR ISOTHERMAL COOKING PULP IN A CONTINUOUS DIGESTER

[75] Inventors: Ake Backlund; Johanna Svanberg, both of Karlstad, Sweden

[73] Assignee: Kvaerner Pulping AB, Karlstad, Sweden

[21] Appl. No.: 689,690

[22] Filed: Aug. 13, 1996

Related U.S. Application Data

[63] Continuation of Ser. No. 348,190, Nov. 29, 1994, abandoned, which is a continuation of Ser. No. 51,396, Apr. 23, 1993, abandoned.

[51] Int. Cl.[6] ..... D21C 7/14; D21C 7/12

[52] U.S. Cl. ..... 162/42; 162/61; 162/249

[58] Field of Search ..... 162/17, 19, 41, 162/42, 45, 61, 250, 251, 249

[56] References Cited

U.S. PATENT DOCUMENTS

| | | | |
|---|---|---|---|
| 3,298,899 | 1/1967 | Laakso | 162/19 |
| 3,802,956 | 4/1974 | Backlund | 162/19 |
| 5,069,752 | 12/1991 | Richter | 162/37 |
| 5,236,554 | 8/1993 | Greenwood | 162/238 |
| 5,567,280 | 10/1996 | Backlund et al. | 162/237 |

FOREIGN PATENT DOCUMENTS

| | | |
|---|---|---|
| 476230 | 3/1992 | European Pat. Off. . |
| 211196 | 2/1967 | Sweden . |

OTHER PUBLICATIONS

Kamyr Drawing 0–0701–1R 32, Jan. 2, 1968.

Ake Backlund, "Extended Delig. of Softwood . . . Digester", TAPPI Journal, Nov. 1984, pp. 62–65.

*Primary Examiner*—Donald E. Czaja
*Assistant Examiner*—Dean T. Nguyen
*Attorney, Agent, or Firm*—Cushman Darby & Cushman Intellectual Property of Pillsbury Madison & Sutro LLP

[57] ABSTRACT

The present invention relates to a digester for continuous cooking under raised pressure and temperature of fibre material in a vertical digester (1), where input of fibre material and cooking liquid takes place at the top of the digester, withdrawal of spent cooking liquor is carried out from at least one digester screening arrangement (1D) between the top and the bottom of the digester, and fibre material is fed out from the bottom (1C) of the digester, wherein the digester (1) is fitted with an additional digester screening arrangement (2) located at less than about 1.5 meters above the lowest screening arrangement (1B) of the digester so that the temperature in all the participatory cooking zones in the digester can be kept at essentially the same temperature level.

6 Claims, 3 Drawing Sheets

FIG. 2
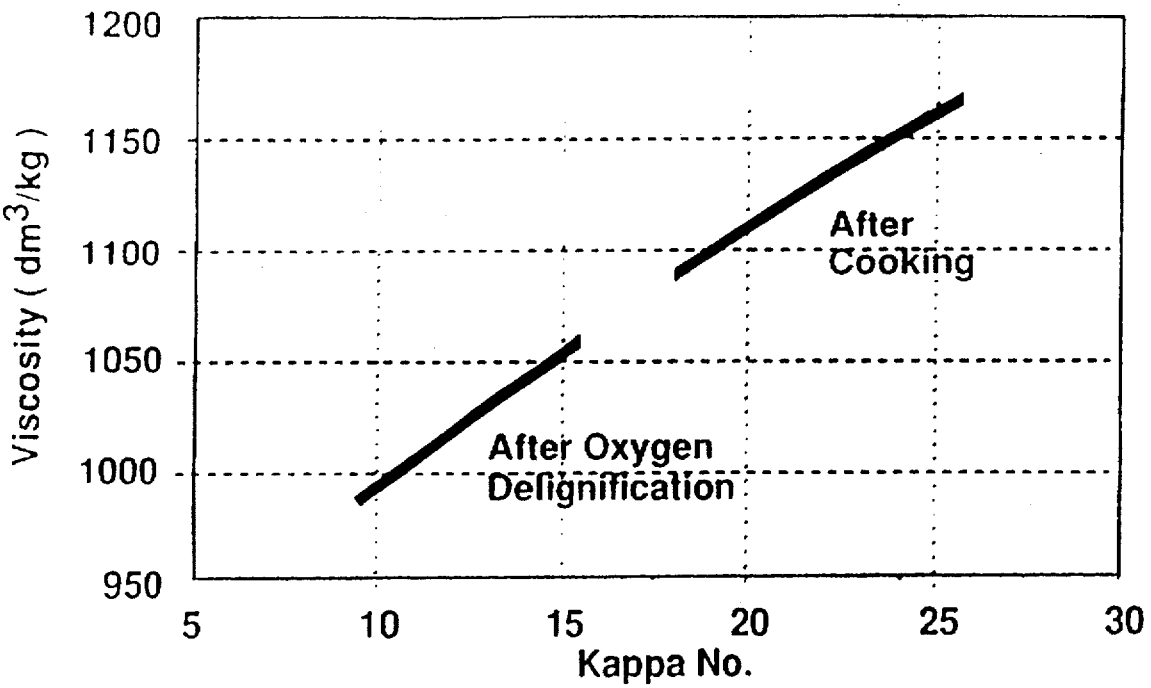
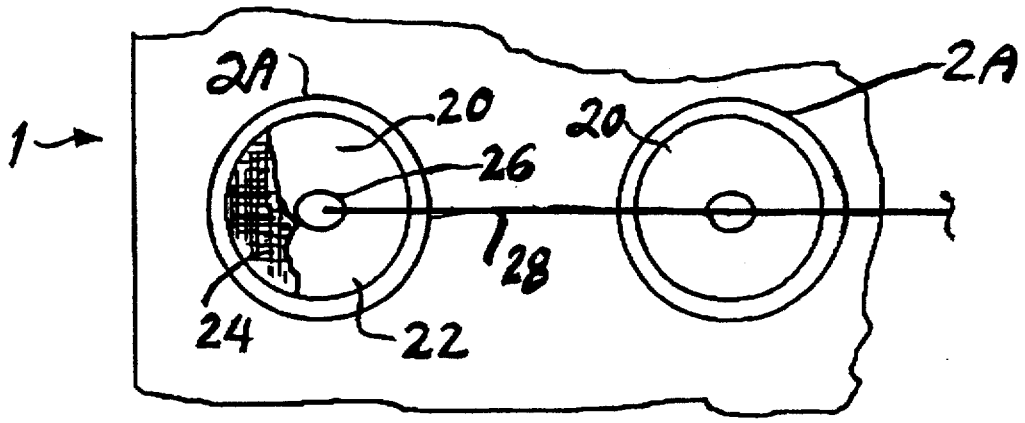
FIG. 4

PROCESS FOR ISOTHERMAL COOKING PULP IN A CONTINUOUS DIGESTER

This is a continuation of application Ser. No. 08/348,190, filed on Nov. 29, 1994, which was abandoned upon the filing hereof and which is a continuation of application Ser. No. 08/051,396, filed Apr. 23, 1993, now abandoned.

FIELD OF THE INVENTION

This invention relates to a process and apparatus for treating cellulosic material such as wood chips for pulp making and, more specifically, for reducing or eliminating the use of environmentally undesireable chemicals in such a process.

BACKGROUND OF THE INVENTION

The environmental authorities are placing ever more stringent demands on the pulp industry to decrease the use of chemicals which can be damaging to the environment, such as, for example, chlorine. Thus, permitted discharges of organic chlorine compounds in the waste water from bleaching plants, following on from the cooking process, have been decreased progressively and are now at such a low level that pulp factories have in many cases stopped using organic chlorine compounds as bleaching agents. In addition, market forces are tending progressively to increase the demand for paper products which are not bleached with chlorine.

The pulp industry is therefore searching for methods which allow bleaching of pulp without using these chemicals. The lignox method (see SE-A 8902058), in which, inter alia, bleaching is carried out with hydrogen peroxide, may be mentioned as an example of such a method. Ozone is another interesting bleaching chemical which is also gaining increased application. It is thus possible, using bleaching chemicals of this nature, to achieve those brightnesses which are required for marketable pulp, i.e. 89 ISO and greater, without using chlorine-containing bleaching agents.

There is, however, a problem in using presently known bleaching procedures with these bleaching chemicals which do not contain chlorine, namely that they have a relatively large effect in diminishing the quality of the pulp fibres.

SUMMARY OF THE INVENTION

By means of experiments which have been conducted under the auspices of Kamyr AB, it has been found, surprisingly, that extremely good results, with regard to delignification and strength properties, can be obtained if the pulp is cooked at the same temperature level in substantially the whole of the digester, i.e., if essentially the same temperature is maintained in all cooking zones, and if a certain quantity of alkali is also supplied to the lowest zone in the digester, which zone is normally used for counter-current washing. Owing to the fact that essentially the same temperature level is maintained in virtually the whole of the digester, very extensive delignification can be achieved at a relatively lower temperature than used previously. In addition, it has been found that the strength properties are affected in a particularly favourable manner, that a higher yield of the crude fibre product is obtained and that the quantity of reject material decreases.

The invention relates to an advantageous arrangement of screens in the digester and feed conduits for achieving a cooking according to the new process, in particular with regard to digesters built according to an older principle and consisting of an upper concurrent cooking zone and a lower counter-current washing zone. Such an arrangement is necessary since certain practical problems arise as a consequence of an isothermal cooking process. The first such problem is the difficulty of efficiently reaching and maintaining the temperature in the lower part of the digester, i.e. that part which is normally employed for washing.

This problem is solved by creating a more efficient circulation and thus temperature distribution in the lower part (the high-heat or washing zone) of the digester. In this context it has been found to be advantageous to use digester screening arrangements consisting of circular screens, in particular so-called , man hole screens where a relatively large circular opening in the digester wall is provided with a circular screen plate that is typically sealed and bolted to the periphery of the opening. With an appropritate distribution of such screen holes, the process is advantageous especially in connection with converting existing digesters, both of the modified type and the older type, for operation according to the new process.

BRIEF DESCRIPTION OF THE DRAWINGS

FIG. 2 shows a diagram which describes degree of delignification and viscosity (the viscosity is normally regarded as indicating the strength properties of the pulp).

FIG. 4 shows a specific type of man hole screens with a portion broken away to reveal a portion of a screen.

DETAIL DESCRIPTION

Figure 1A:
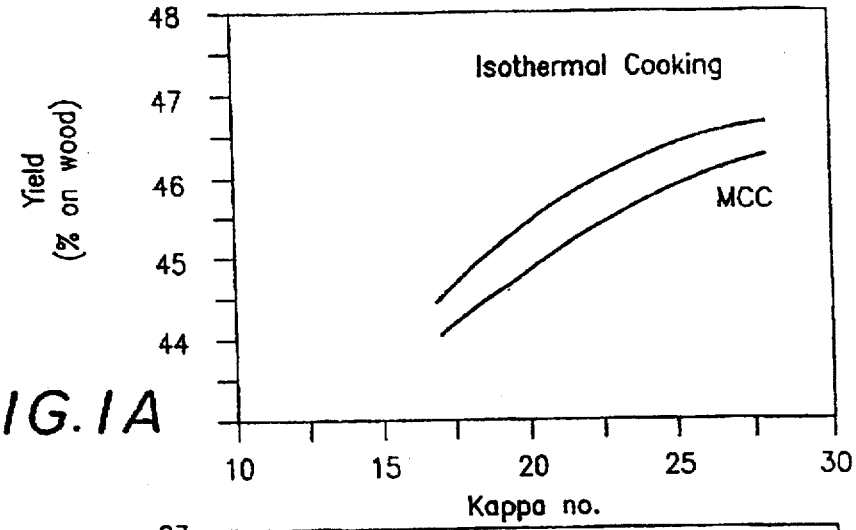
In FIGS. 1A, 1B and 1C, a comparison is made in the three diagrams between isothermal cooking and so-called modified conventional cooking (MCC).
Figure 1B:
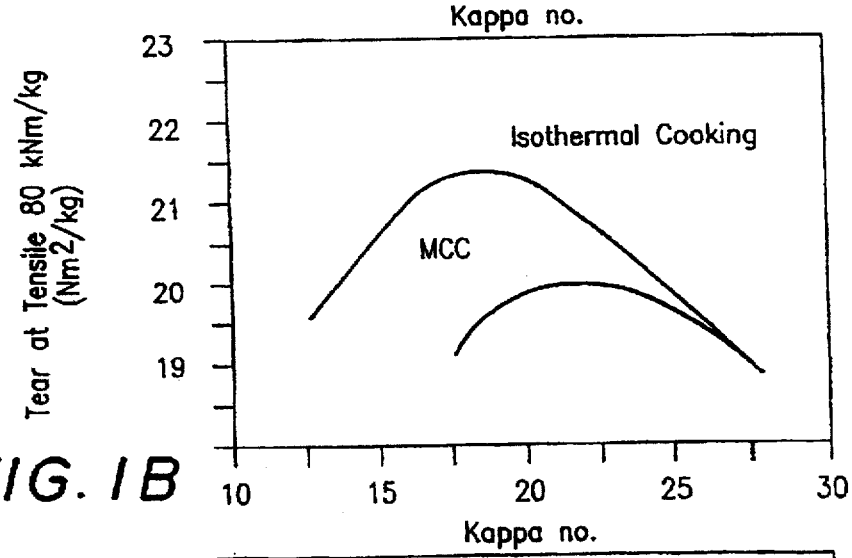
Figure 1C:
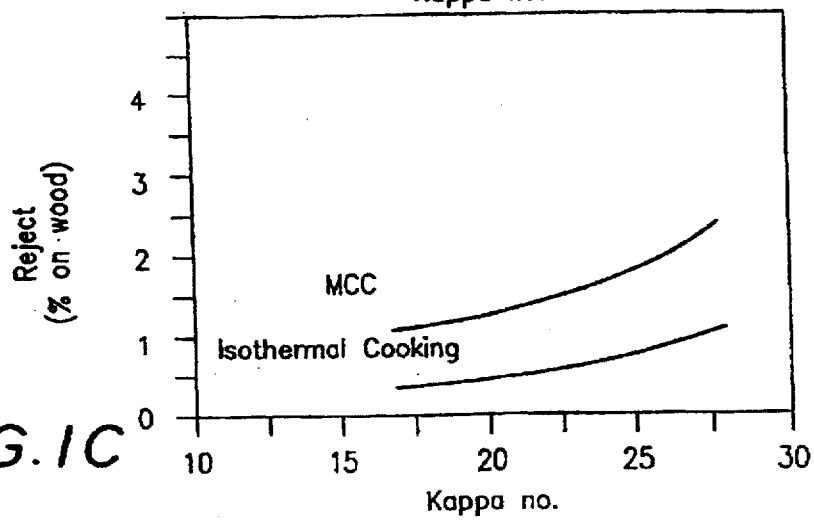

The advantages of the present invention are most clearly apparent from the diagrams shown in the FIGS. 1A, 1B and 1C, which show comparative values between pulp (softwood) which has been cooked using a conventional, modified cooking technique and pulp which has been cooked using the process according to the invention, (in a similar digester, i.e. with a concurrent upper cooking zone, a central counter-current cooking zone and a bottom counter-current washing zone) in which a constant temperature level of about 155° C. has been maintained in the whole digester.

The three diagrams of FIGS. 1A, 1B and 1C compare different results obtained with isothermal cooking and modified conventional cooking (MCC). These surprisingly positive results show, according to diagram 1A, that, with a given amount of added alkali, substantially lower kappa numbers are obtained using isothermal cooking. Furthermore, the second diagram 1B shows that manifestly improved strength properties are obtained when cooking down to the same kappa number. In addition, the third diagram 1C shows that there is also the advantage that the quantity of reject wood (shives) decreases. If the fact is also taken into account that overall substantial energy savings are made when the temperature level is kept constant as well as lower than previous temperatures, it is evident that the results may be regarded as being surprisingly positive. FIG. 2 additionally demonstrates that, using the method according to the invention, very low kappa numbers are reached while at the same time retaining good pulp strength (viscosity of about 1000) after oxygen delignification. Thus, when employing the method according to the invention, so-called environmentally friendly bleaching chemicals, such as peroxide and ozone, can be employed in subsequent bleaching stages without risking too low a strength for bleaching up to the level of brightness, and therewith also the level of purity, which the market demands.

Figure 3:
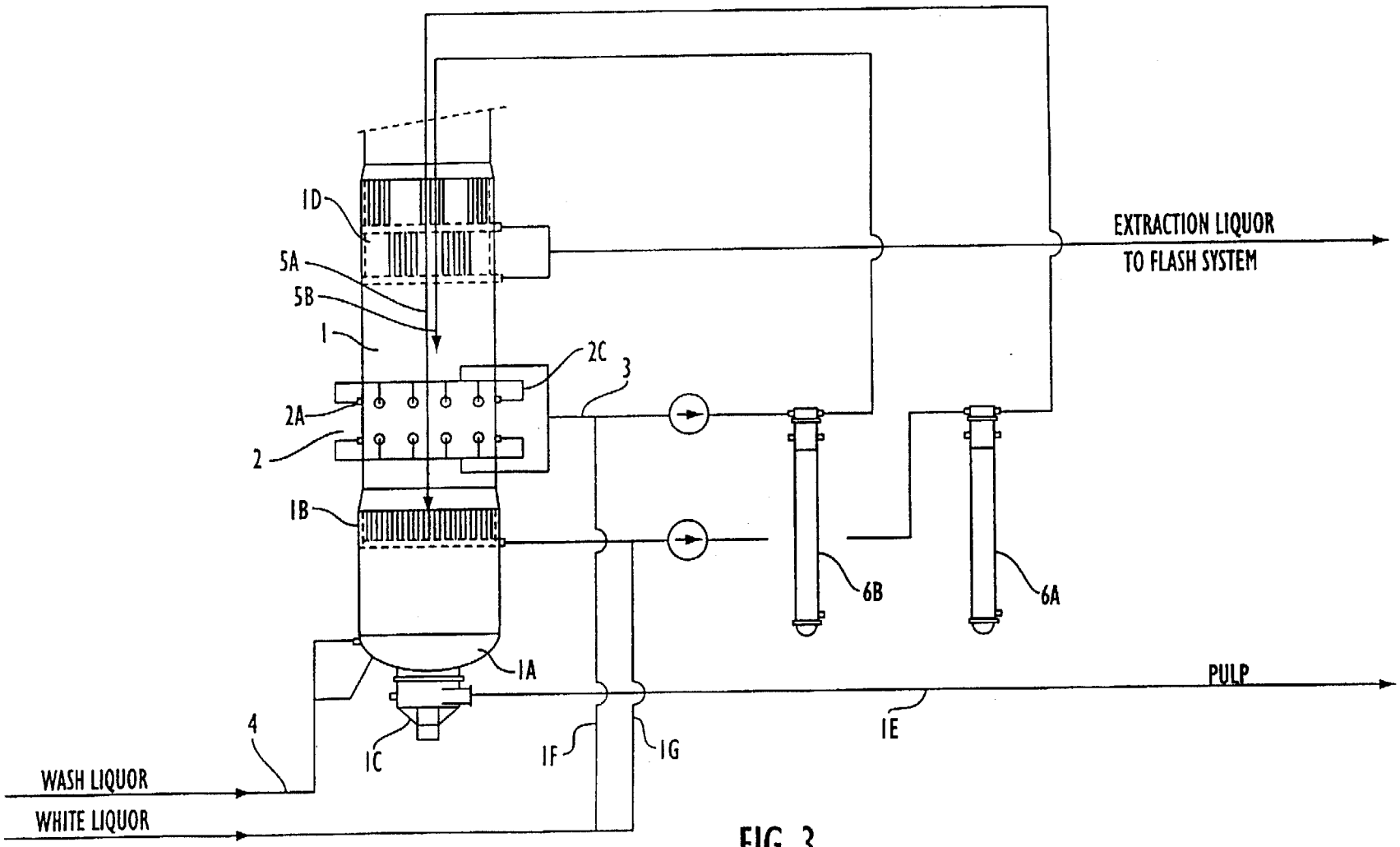
FIG. 3 shows how, in a preferred manner, an existing digester can be converted, using manhole screens, to be operated according to the novel process

FIG. 3 shows the lower part of a digester 1, which is intended to represent an existing digester shell, such as disclosed in commonly owned U.S. Pat. No. 3,802,956 (the disclosure of which is incorporated herein by reference) on which has been arranged a new digester screening arrangement 2 in order to be able to raise the temperature in the counter-current zone. The digester is of the type which may have an upper impregnation zone (not shown) and next has an upper concurrent part and a lower counter-current part. In the past, in such a digester, full cooking temperature is normally maintained in the concurrent zone (i.e. about 162° C. for hardwood and about 168° C. for softwood) while in the counter-current part, which in the main is a washing zone, the temperature is about 135° C. on a level with the lower screen.

According to the present invention, the counter-current zone of the digester which has been fitted with a further screening arrangement will be referred to as a cooking zone, even if it is to be considered as a washing zone according to conventional operation.

The new digester screening arrangement 2 consists of a number of so-called manhole screens 2A for withdrawal 3 of cooking liquid in the lower part of the digester and is arranged immediately above the lower screening arrangement 1B of conventional structure, preferably at most 1.5 meters above and more preferably at most 1 meter above, measured from the upper edge of the lower digester screening arrangement 1B to the lower edge of the newly fitted digester screening arrangement 2A. Wash liquor is supplied to the lower part of the digester through an inflow conduit arrangement 4 attached in the vicinity of the bottom 1A of the digester and cooking liquid (with alkali addition) through the central pipes 5A, 5B. The cooked pulp is taken out from the bottom of the digester via a conduit 1E. Valves 8 and 9, respectively, control introduction of white digesting liquor through pipes 1F and 1G into the circuits for pipes 5B and 5A upstream of the respective heat exchangers 6A and 6B to assist in maintaining the necessary control of the heat content of the liquors introduced as described.

One of these central pipes, 5A, which belongs to the original system of the digester, penetrates down to the lower screening arrangement 1B of the digester, after which a portion of the liquid is drawn off through screen 1B and passed to the heat exchanger 6A. After heating via the first heat exchanger 6A, the liquid is passed back through pipe 5A on a level with the digester screening arrangement 1B to maintain the desired isothermal temperature condition at this zone of the digester. Subsequently, a part of the liquid flows in a countercurrent direction upwards towards the newly fitted digester screening arrangement 2 comprising the screens 2A. The liquid withdrawn from this system of screens 2A passes through the conduit arrangement 3 and is heated via a heat exchanger 6B to the desired temperature before it discharges, via a second, central pipe 5B, provided according to the present invention, immediately above the newly fitted digester screening arrangement 2, as shown. A part of the cooking liquid supplied in this manner through pipe 5B, which liquid has thus achieved the desired temperature, chemical strength and distribution over the whole of the cross-section of the digester, continues to flow upwards in the digester toward the originally installed screen arrangement 1D. In the central digester screening arrangement 1D, the spent cooking liquid, together with undissolved wood material, is drawn off for further treatment. Above the screen arrangement 1D, may be provided a level control device such as a strainer 1H of conventional construction.

The surface of each screening element 2A is made relatively small, preferably less than 0.3 $m^2$. An advantage of screening elements of small area is that efficient back flushing can be achieved, which is often of great importance if the circulation flow is to function efficiently. The new screening arrangement 2 is preferably fitted with ring pipes 2C from which an individual conduit goes to each and every one of the screening elements 2A. Using such a construction, and a valve arrangement in the associated conduits for each element 2A, a limited number (for example 4) of screening units 2A can be efficiently backflushed at a time. In FIG. 4, two adjacent screen elements are shown. A plurality of these will be evenly spaced about the circumference of the vessel 1 and each has an outer wall 20. In screen element 22, the wall 20 is broken away to show the underlying screen 24 itself. A valve 26 is placed in the conduit 28 connected through the outer wall 22. Owing to the relatively small total screening surface which is backflushed under these circumstances (for example 1 $m^2$), a very efficient backflushing which cleans the screens is obtained, thereby ensuring that the circulation is highly efficient.

It will be apparent that very close control of the temperature of contents of the digester in the counter current zone and the extended phase zone beneath the new screen arrangement 2 can be achieved by the provided apparatus to assure substantially isothermal conditions in the concurrent, counter-current and extended phase, formerly washing, zones.

The invention is not limited by that which has been described above, but can be varied within the scope of the subsequent patent claims. Thus, an existing digester of the modified continous cooking type can also be arranged in accordance with the invention, where, therefore, the digester has an upper concurrent part, a central, mainly countercurrent part and a lower counter-current part, where addition of a part of the cooking liquid takes place in the said lower counter-current part, the so-called high heat zone. A digester of the so-called hydraulic type, with a lower temperature in the upper part (the impregnation zone), may also advantageously be fitted with a digester screening arrangement according to the invention for cooking according to the invention, that is, isothermally. Additionally the method may be used in connection with all types of cooking liquid, even if the method is principally intended for producing sulphate pulp. In addition, it is obvious to the person skilled in the art that the invention is not limited to the abovementioned exemplifying temperature levels. In this connection, however, it is important that the average temperature level in the digester preferably exceeds 150° C. but is lower than 165° C., and preferably is between 150°–155° C. for hardwood and between 160°–165° C. for softwood, and furthermore that the average temperature in the cooking zone/zones is preferably about 151°C.±1°C., when the wood is hardwood, and that the average temperature in a digester is 159° C.±1° C., when the wood is softwood. In addition, it is understood that screens deviating from a purely circular form, for example oval screens, may also be used, whereby, for technical reasons related to the construction, the smallest radius of curvature should not fall below 0.2 m. Finally, it is pointed out that new digesters can readily also be fitted with screening arrangements, and be operated, according to the invention.

What is claimed is:

1. In a process for digesting hard wood cellulosic material using a digester apparatus of the type including a vessel having a vertically disposed longitudinal axis, a top portion having an inlet for the cellulosic material and at least one inlet for digesting liquor, a central portion and a bottom portion including an outlet for the digested material, first screen members located intermediate the top and bottom portion for removal of digesting liquor, second screen members adjacent the bottom portion for withdrawing liquor for recycling to a location in the digester beneath the central portion and third screen members located between said first and second screen members for removing liquor from the vessel, said third screen members each having a circular man-hole shape and an upper edge, heating means for heating the liquor removed through said third screen members and conduit means for introducing the liquor heated by the heating means into the vessel at a point adjacent said third screen members, the improvement comprising the steps of:

a) introducing the hard wood cellulosic material and digesting liquor into the vessel through the respective inlets, b) removing a first portion of the digesting liquor at a selected temperature from the vessel through the first screen members, c) removing a second portion of the digesting liquor from the vessel through the second screen members, heating the second portion and reintroducing the heated second portion into the vessel, d) removing a third portion of the liquor through the third screen members, heating the third portion and reintroducing the heated third portion into the vessel at a point between the first and second screen members wherein said third screen members is located closer to said second screen members than to said first screen members and said step of reintroducing includes reintroducing said third portion at a point located near the upper edges of the third screen members and the third screen members are spaced less than about 1.5 meters above said second screen members, e) maintaining the temperature of the contents of the vessel at a selected temperature in the range 150°–155° C. to digest the material in the vessel, and f) removing digested material from the bottom of the vessel.

2. The process of claim 1 wherein the step of heating the liquor withdrawn from the vessel through the second screen members is carried out by passing the liquor to a heat exchanger.

3. The process of claim 2 wherein the step of reintroducing the heated second portion into the vessel includes reintroducing the heated second portion of the liquor at a location adjacent said second screen members and below said third screen members.

4. In a process for digesting soft wood cellulosic material using a digester apparatus of the type including a vessel having a vertically disposed longitudinal axis, a top portion having an inlet for the cellulosic material and at least one inlet for digesting liquor, a central portion and a bottom portion including an outlet for the digested material, first screen members located intermediate the top and bottom portion for removal of digesting liquor, second screen members adjacent the bottom portion for withdrawing liquor for recycling to a location in the digester beneath the central portion and third screen members located between said first and second screen members for removing liquor from the vessel, said third screen members each having a circular man-hole shape, heating means for heating the liquor removed through said third screen members and conduit means for introducing the liquor heated by the heating means into the vessel at a point adjacent said third screen members, the improvement comprising the steps of:

a) introducing the soft wood cellulosic material and digesting liquor into the vessel through the respective inlets, b) removing a first portion of the digesting liquor at a selected temperature from the vessel through the first screen members, c) removing a second portion of the digesting liquor from the vessel through the second screen members, heating the second portion and reintroducing the heated portion into the vessel, d) removing a third portion of the liquor through the third screen members, heating the another portion and reintroducing the heated third portion into the vessel at a point between the first and second screen members wherein said third screen members is located closer to said second screen members than to said first screen members and said step of reintroducing includes reintroducing said third portion at a point located approximately above the upper edges of the third screen members which are spaced above said second screen members no more than about 1.5 meters, e) maintaining the temperature of the contents of the vessel at a selected temperature in the range 160°–165° C. to divest the material in the vessel, f) removing digested material from the bottom of the vessel.

5. The process of claim 4 including the step of heating the liquid withdrawn from the vessel through the second screen members which includes passing the liquid to a heat exchanger.

6. The invention as claimed in claim 5 wherein the step of reintroducing the heated second portion into the vessel includes reintroducing the heated second portion of the liquid at a location adjacent said second screen members and below said third screen members.

* * * * *